United States Patent [19]

Stunzi

[11] Patent Number: 4,808,964

[45] Date of Patent: Feb. 28, 1989

[54] EROSION RESISTANT HIGH CURRENT DRAW-OUT FUSEHOLDER

[75] Inventor: Joseph M. Stunzi, Athens, Ga.

[73] Assignee: Westinghouse Electric Corp., Pittsburgh, Pa.

[21] Appl. No.: 137,790

[22] Filed: Dec. 24, 1987

[51] Int. Cl.[4] ..... H01H 85/16; H01H 85/02

[52] U.S. Cl. ..... 337/252; 337/204; 337/251

[58] Field of Search ..... 337/204, 248, 246, 251, 337/252, 158, 186, 227, 228, 253

[56] References Cited

U.S. PATENT DOCUMENTS

| | | | |
|---|---|---|---|
| 1,853,093 | 4/1932 | Steinmayer . | |
| 2,781,434 | 2/1957 | Swain | 200/131 |
| 3,222,482 | 12/1965 | Hitchcock | 200/132 |
| 3,911,385 | 10/1975 | Blewitt et al. | 337/202 |
| 3,979,709 | 9/1976 | Healey, Jr. | 337/186 |
| 4,320,375 | 3/1982 | Lien | 337/204 |
| 4,625,196 | 11/1986 | Muench et al. | 337/204 |
| 4,628,292 | 12/1986 | Muench et al. | 337/204 |

FOREIGN PATENT DOCUMENTS 563600 8/1944 United Kingdom .

*Primary Examiner*—H. Broome
*Attorney, Agent, or Firm*—Daniel P. Cillo

[57] ABSTRACT

A draw-out fuseholder 10 is made containing a first, electrically conductive metal fuse contact 11 having an outer chamfer 12 and a circumferential top surface 13, a second, extended, electrically conductive metal fuse contact 14 having an inner chamfer 15, an outer chamfer 16, and a circumferential top surface 17, and insulating tube 18 comprising fiber reinforced, thermoset resin between the fuse contacts, where the top of the insulating tube has a sharp edge 19 and discontinuity 20 near the second fuse contact inner chamfer 15, and where the ratio of first fuse contact exposed length 25: second fuse contact exposed length 26 is from 1:1.3 to 1:2.5. This fuseholder 10 can be placed in the housing 32 of a draw-out device 30, where housing contact sets 39 and 40 mate with the fuse contacts 14 and 11 in an at-rest position.

11 Claims, 4 Drawing Sheets

EROSION RESISTANT HIGH CURRENT DRAW-OUT FUSEHOLDER

BACKGROUND OF THE INVENTION

This invention relates to an erosion resistant, high current, draw-out fuseholder having a first, electrically conductive metal fuse contact having an outer chamfer, a second, extended, electrically conductive metal fuse contact having an outer chamfer and an inner chamfer, and an insulating tube between the fuse contacts, where the top of the tube has a sharp edge and discontinuity near the second fuse contact inner chamfer. This fuseholder can be used in pad mounted and submersible distribution transformers.

Replaceable, under oil expulsion fuses are generally used in high voltage systems to protect electric devices from fault currents, and are disclosed in U.S. Pat. No. 4,320,375 (Lien). There, the fuse holder includes a glass wound tube, impregnated with epoxy resin, covering an inner pressure tube of a nontracking, nonconducting material, such as polytetrafluoroethylene (Teflon). This composite, tubular, insulating structure is disposed between and fitted flush with two electrically conductive contacts having similar lengths and configurations, each fuse contact having an outer chamfered surface. A metallic fuse element which will melt at a particular load current or temperature, to interrupt the circuit, extends through the interior of the hollow tubular structure between the contacts. The fuse holder is shown mounted in an open housing which is totally immersed in insulating oil. If spring loaded housing contacts are used which touch each of the same length fuse contacts perpendicular to the fuse contact surface, as ,is the case in certain types of housing arrangements, upon withdrawal of the fuseholder, the upper spring loaded housing contact can disengage first and an electric arc can form at the upper fuse contact, causing pitting at that surface.

Similar type expulsion fuses, having a glass epoxy-Teflon pressure tube between threadedly mounted metal contacts of similar length and configuration, each having a diameter substantially greater than the pressure tube, are disclosed in U.S. Pat. No. 4,625,196 (Muench et al.). In this patent, primarily directed to the fuse assembly, both metal contacts have a beveled inner chamfer so that the pressure tube substantially "blends" into the contacts. In a modification of this design, U.S. Pat. No. 4,628,292 (Muench et al.) discloses a single layer, glass epoxy pressure tube between threadedly mounted metal contacts, each having a diameter substantially greater than the pressure tube. In this patent, also primarily directed to the fuse assembly, one metal contact has a beveled inner chamfer and the other metal contact, which appears elongated, has a sharp inner edge, and contains both an inner pressure chamber and vent holes through the contact surface to the pressure chamber.

Earlier art had disclosed the use of fuseholders having two fuse contacts of the same length and configuration having inner chamfers smoothly mating to a central insulating tube, as shown in British Patent No. 563,600 (Sowood et al.); U.S. Pat. No. 2,781,434 (Swain); U.S. Pat. No. 3,222,482 (Hitchcock) and U.S. Pat. No. 3,979,709 (Healey, Jr.). U.S. Pat. No. 3,911,385 (Blewitt et al.) discloses contacts of the same length and configuration, but with an outward fuse contact extension at the juncture with the central insulating tube. U.S. Pat. No. 1,853,093 (Steinmayer) appears to disclose fuse contacts having different lengths and configurations, but the contacts cover most of the insulating tube and the longer contact butts against a porcelain flanged insulating member.

All such structures would not appear to solve arcing between a spring loaded housing contact and the circumferential top mating surface of the fuseholder contacts upon withdrawal of the fuseholder, which arcing causes pitting and erosion of the contact surfaces and the insulating tube. It is the object of this invention to solve such problems.

SUMMARY OF THE INVENTION

Accordingly, the invention resides in an erosion resistant, high current, draw-out fuseholder, characterized in that said fuseholder comprises a first, electrically conductive metal fuse contact having an outer chamfer and a circumferential top surface; a second, extended, electrically conductive metal fuse contact having an inner chamfer, an outer chamfer, and a circumferential top surface; and an insulating tube comprising fiber reinforced, thermoset resin between the fuse contacts, where the top of the insulating tube has a sharp edge and discontinuity near the second fuse contact inner chamfer, and where the ratio of first fuse contact exposed length: second, extended fuse contact exposed length is preferably from 1:1.3 to 1:2.5.

The invention also resides in an oil-immersed draw-out expulsion device for use with an electrical distribution apparatus, where the expulsion device includes (1) a housing having a bottom end adapted to be in contact with a dielectric fluid and also having spaced top and bottom pressure loaded housing contact sets and (2) a removable draw-out fuseholder within said housing, said draw-out fuseholder characterized in that the fuseholder comprises a first, electrically conductive metal fuse contact having an outer chamfer and a circumferential top surface, a second, extended, electrically conductive metal fuse contact having an inner chamfer, an outer chamfer and a circumferential top surface, and an insulating tube comprising fiber reinforced, thermoset resin between the fuse contacts, where the top of the insulating tube has a sharp edge and discontinuity near the second, fuse contact inner chamfer, where the ratio of first fuse contact exposed length second, extended fuse contact exposed length is preferably from 1:1.3 to 1:2.5, and where the housing contacts can be in engagement with the fuseholder such that the bottom housing contact set is completely disengaged from the first fuse contact when the top housing contact set is still in contact with the second, extended fuse contact, and also when the top housing contact set is disposed over the discontinuity and second fuse contact inner chamfer.

Preferably, the fuse contacts are brass, the thermoset resin used in the insulating tube is a cycloaliphatic epoxy resin, and any arc generated upon fuseholder removal from or insertion into the housing will contact only the chamfer areas of the fuseholder. By using the extended fuse contact, with a sharp tube insulating edge near the contact inner chamfer, arcing is localized at the chamfer areas of the fuseholder, and as withdrawal continues, sufficient dielectric fluid will be present near the bottom end of the housing to extinguish the bottom arc.

BRIEF DESCRIPTION OF THE DRAWINGS

In order that the invention can be more clearly understood, convenient embodiments thereof will now be described, by way of example, with reference to the accompanying drawings in which.

DESCRIPTION OF THE PREFERRED EMBODIMENTS

Figure 1:
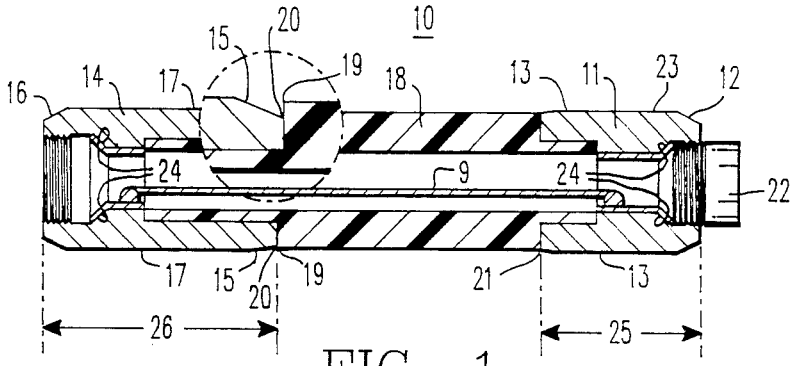
FIG. 1, which best illustrates the fuseholder of this invention, is a sectional view, partly in elevation, of an erosion resistant, high current, draw-out fuseholder, showing asymmetrical axial contacts, and a sharp insulating tube edge near the inner chamfer of the extended contact.

Referring now to FIG. 1, a fuseholder 10 is shown, having a first, electronically conductive metal fuse contact 11, having an outer or end chamfer or beveled portion 12, and a circumferential top surface 13. A second, extended, electrically conductive metal fuse contact is shown as 14, having an inner chamfer or beveled portion 15, an outer or end chamfer or beveled portion 16, and a circumferential top surface 17.

An insulating tube 18, comprising a fiber reinforced, preferably a filament wound glass fiber reinforced, thermoset resin is disposed between the contacts 11 and 14. The preferred thermoset resin used in the insulating tube is a cycloaliphatic epoxy resin, well known in the art, cured with an acid anhydride or Lewis Acid, and preferably containing inorganic filler particles such as naturally occurring magnesite ($MgCO_3$) or alumina trihydrate ($Al_2O_3 \cdot 3H_2O$), which have arc quenching capabilities. As shown, a portion of the tube 18 generally extends underneath a certain portion of each contact 11 and 14. The tube 18 may comprise one or more component parts, all containing thermoset resin.

The top of the insulating tube has a sharp edge 19, and circumferential discontinuity or gap 20 near or next to the second metal fuse contact inner chamfer 15. The inner chamfer 15 of the extended fuse contact 14 and gap 20 are set below the gliding surface used by the housing contacts. This sharp edge and discontinuity are essential in the erosion resistant design of the fuseholder of this invention, as will be discussed hereinafter. The beveled or chamfer portion of this combination must be metal and the sharp portion must be the resin containing tube portion. The first contact 11 can have a slight bend or bevel at point 21 but the insulating tube is "blended" into the contact so that there are no sharp edges or gaps at point 21.

The fuseholder contacts 11 and 14 will be made of a metal such as copper, or preferably brass. In one design a hollow metal end connector 22 can be inserted into the bottom end 23 of the fuseholder, to help hold the fuse element 9 in place. It may in some designs also act as an electrical lead connection point. The fuse element is usually container tubular polytetrafluoroethylene (Teflon) container (not shown) of smaller diameter than the inner diameter of the tube 18. The has end portions that will mate to the contacts at flange points 24.

The ratio of first fuse contact external exposed length 25: second, extended fuse contact external exposed length 26 is preferably from 1:1.3 to 1:2.5, and most preferably 1:1.4 to 1:2.0. Such exposed lengths include any beveled portions but exclude the length of end connector 22. Less than a 1:1.3 ratio, for example a 1:1.2 ratio, arc extinction upon fuseholder withdrawal from an expulsion device would not be improved to any substantial degree. Over a 1:2.5 ratio the fuseholder would not pass electrical requirements because the insulating tube would be too short. The preferred angle of inner chamfer 15 of the extended contact is from 20° to 45° from the longitudinal axis of the fuseholder as shown. The sharp edge 19 of the insulating tube is preferably machined to a 90° angle from horizontal, as shown.

The fuseholder 10 is of a replaceable type and is part of an oil-immersed draw-out expulsion device 30, shown in part in FIGS. 2 to 5. The expulsion device 30 is used with an electrical distribution apparatus, such as a pad-mounted electrical distribution transformer, including an enclosed metallic tank with a core-coil assembly, which includes a primary winding immersed in a suitable liquid dielectric 31, such as mineral oil, as is well known in the art. The expulsion device 30 is partly immersed in the liquid dielectric 31, which can flow into and around the fuseholder 10, which is disposed in housing 32. The housing 32 is usually tubular, and made from thermoset resin impregnated, filament wound glass fibers, and may contain an open "window" portion 33. The fuseholder 10 can be connected to pull shaft 34 by means of metal adapter 35. The pull shaft 34 can be a thermoset resin impregnated glass fiber tube.

Figure 2:
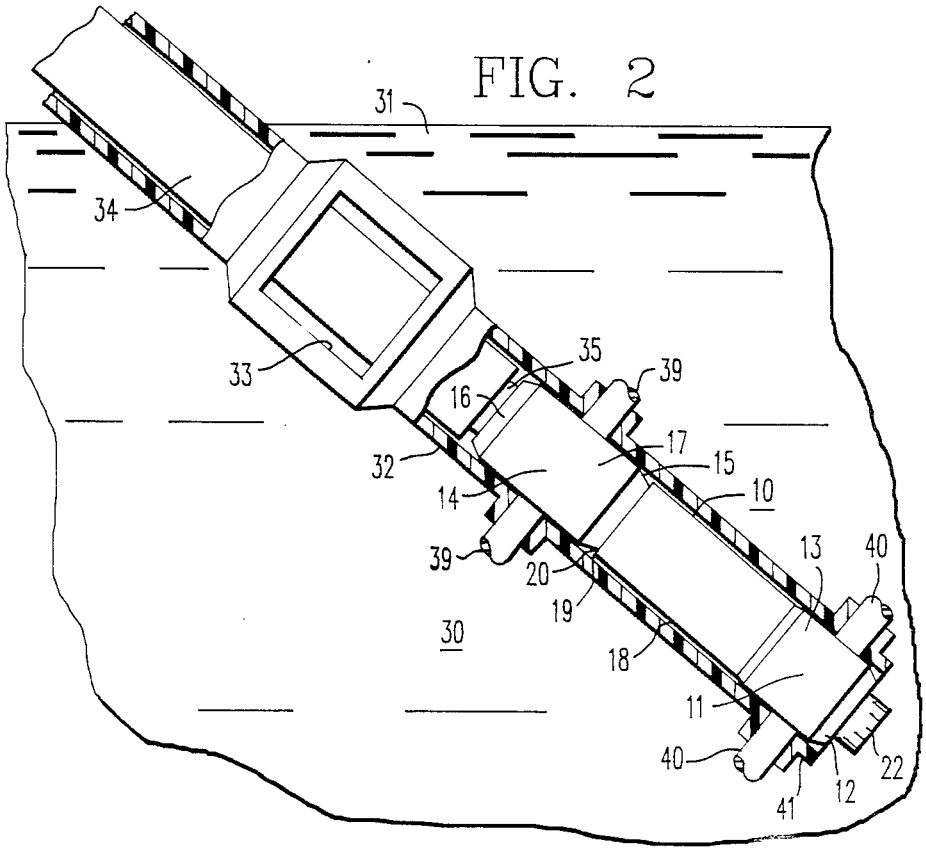
FIG. 2, which best illustrates the draw-out device of this invention, is a sectional view, partly in elevation, of an oil-immersed draw-out expulsion device, including a housing and draw-out fuseholder in an at-rest position with housing contacts mated to the two contact ends of the fuseholder, all disposed in a liquid dielectric.

Two sets of pressure mounted, usually spring mounted, housing contacts, top set 39 and bottom set 40, usually made of copper, are shown, with set 40 at the bottom end 41 of the housing 30. These housing contact sets will usually contain four contacts per set, each arranged 90° from the other, around the circumferential top surface of the fuseholder contacts 11 and 14. FIG. 2 shows the fuseholder in an at-rest position, where there is complete electrical mating of the fuse contacts 11 and 14 and housing contact sets 39 and 40.

Figure 3:
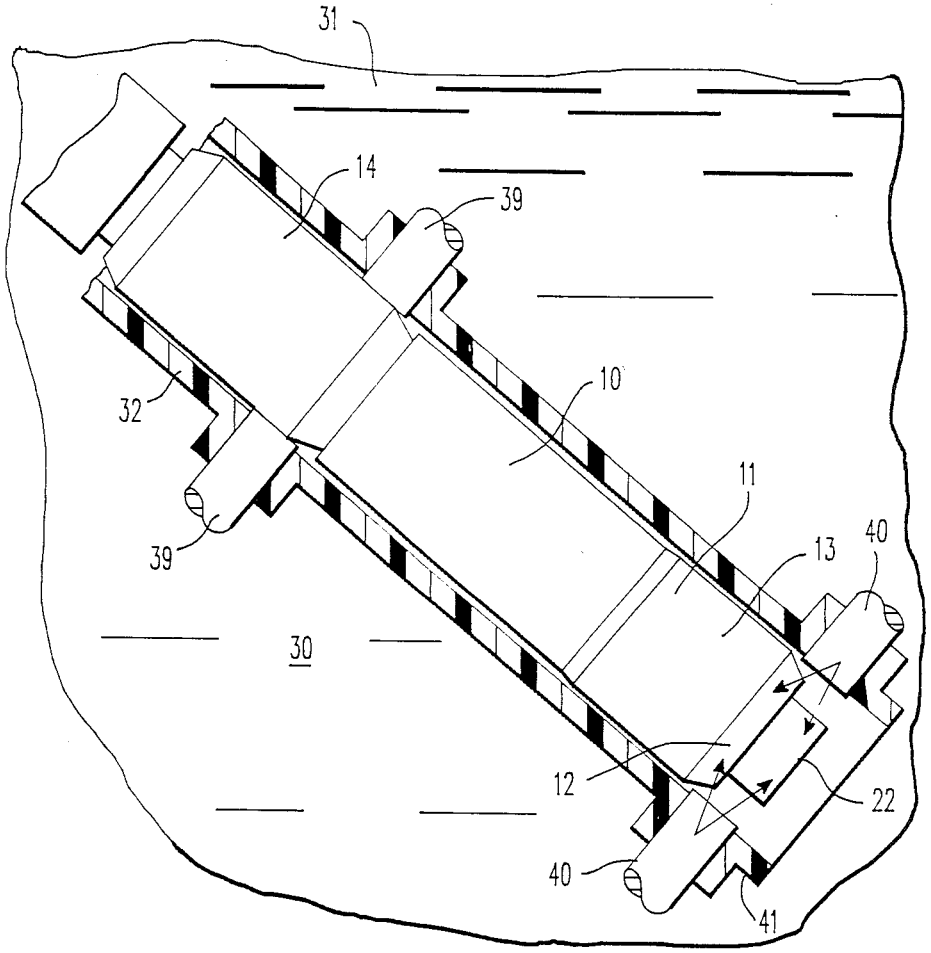
FIG. 3 is a sectional view, partly in elevation, of the oil-immersed draw-out expulsion device, with the draw-out fuseholder in a first draw-out position.

In FIG. 3, the fuseholder 10 is shown in a first stage of removal from the housing 30. Removal of the fuseholder may be just to check its operation, or to remove and replace a melted fuse element. If the fuse is intact, unless the transformer power is turned off, there will be a high voltage potential between fuse contacts 11 and 14. The following description regarding arcing, will involve the situation where the fuse is intact.

As can be seen in FIG. 3, the bottom set of housing contacts 40 no longer mate to the bottom fuse contact 11, but solely contact the liquid dielectric at the bottom end of the housing 41 and the top set of housing contacts 39 still mate to the extended fuse contact 14. At this first withdrawal position, an electric arc will be generated first between the end of the bottom set of housing contacts 40 and the outer chamfer portion 12 of first fuse contact 11, followed by arcing to the end connector 22, as shown by the arrows. There is no arc generated yet at the second, extended fuse contact 14. Arcing at the second fuse contact would have already occurred if the fuse contact 14 was the same length as fuse contact 11 so that an upper arc would be generated at the same time a lower arc is generated. Little arcing is directed to the circumferential top surface 13 of the first fuse contact 11, so that substantially no erosion or pitting is caused at surface 13.

Figure 5:
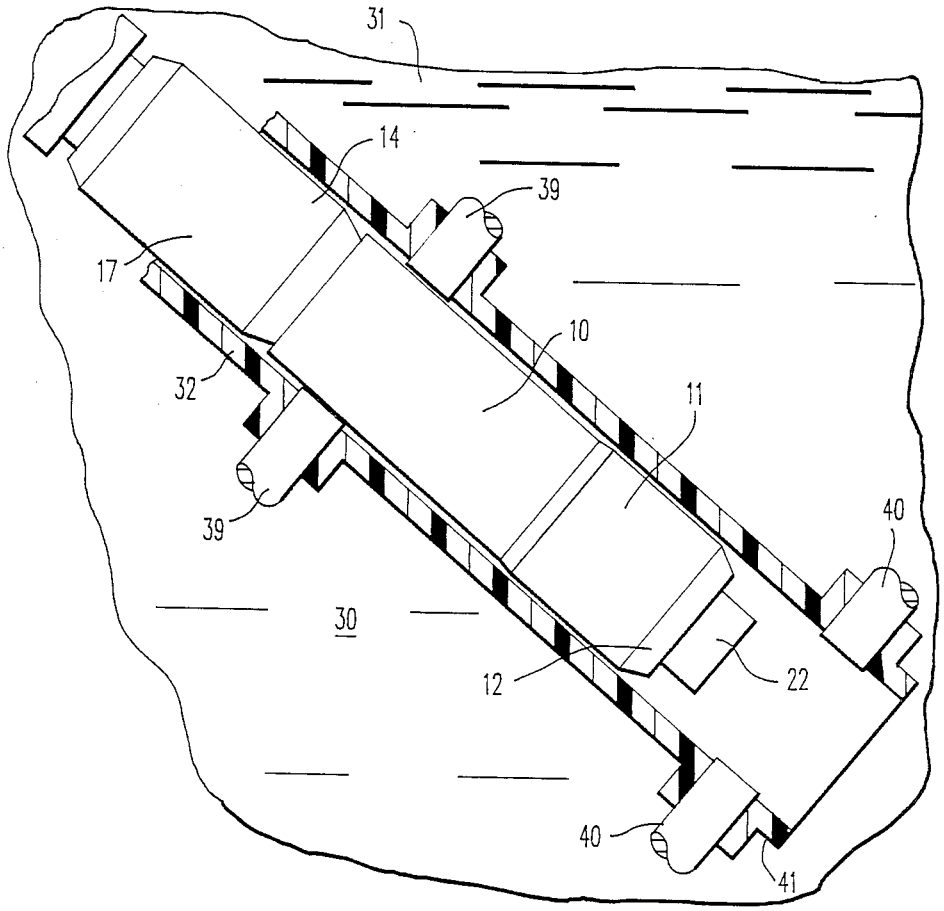
FIG. 5 is a sectional view, partly in elevation, of the oil-immersed draw-out expulsion device, with the draw-out fuseholder in a third draw-out position.

During this arcing, the dielectric fluid 31 in the vicinity of the arc is rapidly heated up and is being blown out of the way, but the entire fuseholder 10 is being pulled away from the bottom set of housing contacts 40, so that more and more dielectric fluid is present to extinguish the arc, until, as shown in FIG. 5, electrical arcing between the bottom set of housing contacts 40 and the outer chamfer portion 12 and end connecter 22 is completely extinguished.

Figure 4:
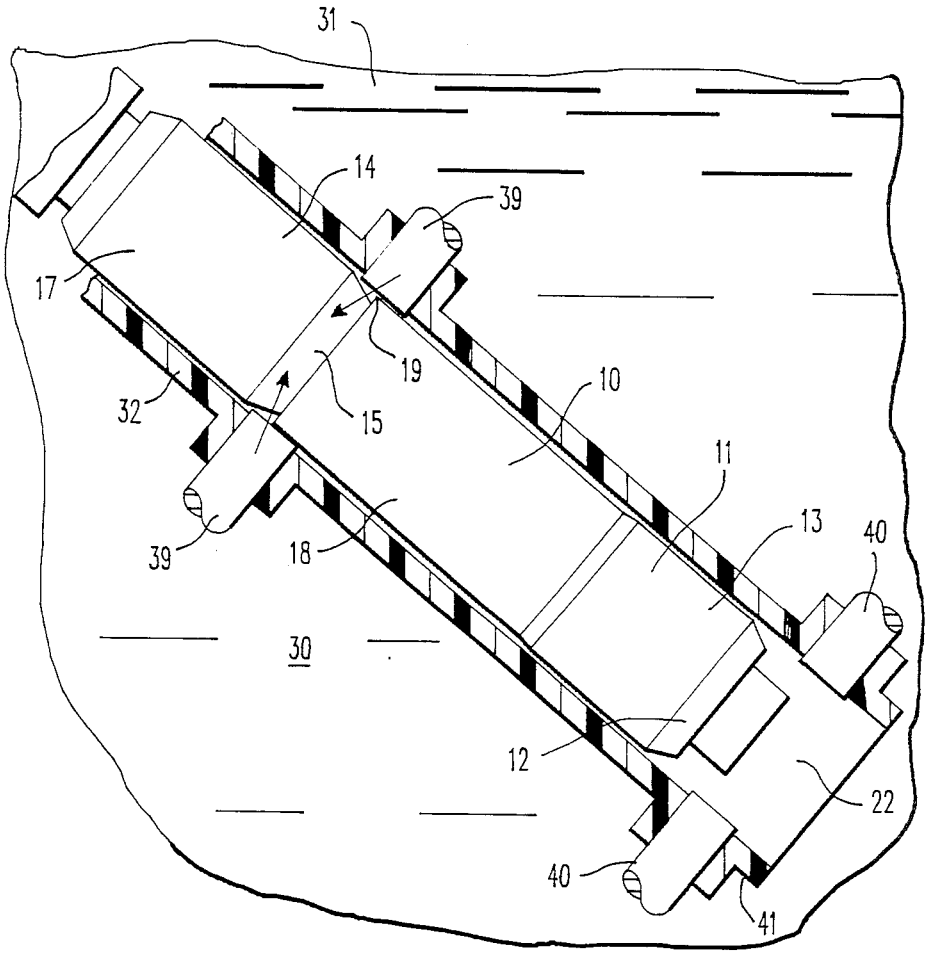
FIG. 4 is a sectional view, partly in elevation, of the oil-immersed draw-out expulsion device, with the draw-out fuseholder in a second, more advanced, draw-out position.

At about the time shown in FIG. 4, the top set of housing contacts 39 rest over the second, extended contact inner chamfer 15 and the discontinuity or gap 20 between the insulating tube 18 and the second, extended fuse contact inner chamfer 15. As shown in FIG. 4, electrical arcing will be primarily directed between the end of the top set of housing contacts 39 and the inner chamfer portion 15 of the second, extended fuse contact 14. There may still be minor arcing generated at the other end of the fuseholder at this time. Only minor arcing is generated to the circumferential top surface 17 of the extended contact 14, so that little erosion or pitting is caused at surface 17. During the arcing, the dielectric fluid 31 is rapidly heated up but the discontinuity or gap allows more dielectric fluid to be present to help control arcing. The gap and sharp edge 19 cause the arc to be drawn out longer, which aids in its cooling and extinction. Pull out as shown in FIG. 5 results in total extinguishment of all arcing.

Thus, all electrical arcing is directed away from the flat circumferential top surfaces 13 and 17 so that minimal erosion or pitting occurs and the fuseholder can be reused 5 or more times with good mating between fuse contacts and housing contacts. As can be seen, the use of the asymmetrical axial contacts transfer a majority of arcing activity to the lower set of contacts which is exposed to less restrictive dielectric liquid flow at the open bottom end of the housing.

The invention will now be illustrated with reference to the following Example.

EXAMPLE

A number of fuseholders were made. They had a total length of about 11.1 cm. (4.38 inch), with an exposed external first contact length of about 2.7 cm. (1.06 inch) and an exposed external second contact length of about 4 cm. (1.57 inch) providing a length ratio of 1:1.48. Each fuse contact was made of brass and machined with 30° outer chamfers and 30° inner chamfers. An insulating tube was connected between fuse contacts by a series of hardened steel pins which went through the contact to the underlying tube portion of the fuseholder, providing a mechanical joint. The end of the insulating tube near the first, smaller contact, was blended into the inner chamfer so that only a small part of the inner chamfer showed. The end of the insulating tube near the second, elongated contact, was machined to a sharp edge which dropped to the inner chamfer, creating a discontinuity or gap between the inner chamfer and the insulating tube, as shown in FIG. 1.

The insulating tube contained filament wound glass fibers impregnated with a cycloaliphatic epoxy resin containing an anhydride curing agent and alumina trihydrate filler. The contacts had inner threads and flange points, the latter to accommodate a fuse element. These fuseholders were tested for torque resistance, arc interruption performance and other tests, and the results are tabulated below in Table 1.

TABLE 1

| Test | | |
|---|---|---|
| 1. | Ave Torque To Failure | 354 in-lb. |
| 2. | 180 kV Impulse Test | Passed |
| 3. | Power Frequency Tests | |
| | 60 kV at 25° C. oil temp | Passed |
| | 50 kV at 140° C. oil temp | Passed |
| 4. | Load Make/Break Tests | |
| | 8.3 kV at 135 Amps | Passed |
| | 14.4 kV at 135 Amps | Passed |
| | 26.7 kV at 40 Amps | Passed |
| 5. | Interruption Tests | |
| | 8.3 kV at 3810 Amps, 10° Closing Angle | 5 Tests: All Cleared |
| | 8.3 kV at 4126 Amps, 12° Closing Angle | 2 Tests: All Cleared |
| | 15.5 kV at 2192 Amps, 9° Closing Angle | 4 Tests: All Cleared But Damaged on 4th Test, So 5th Test Could Not be Performed |
| | 15.5 kV at 2032 amps, 9° Closing Angle | 5 Tests: All Cleared |
| | 23.0 kV at 590 amps, 0° Closing Angle | 5 Tests: All Cleared |

In Test 1, the fuseholder was mounted in a test fixture and torque applied until the brass contact rotated. In Test 2, impulse voltage was applied between the two brass contacts in ambient oil. One flashover or breakdown constituted a failure at that level. In Test 3, a fuseholder was placed in a test tank filled with high temperature mineral oil. A test panel was used to simulate a transformer tank wall. Power frequency voltage was applied between the brass contacts on the fuse cartridge. The voltage was applied to each sample for one minute, a minimum rest period of one minute (voltage=0) followed, and then the test voltage was reapplied for one minute. The fuseholder had to withstand both voltage applications to pass.

In Test 4, a fuse holder was subjected to load make/-break tests to determine the rated switching current it is capable of closing and interrupting. The fuseholder was subjected to ten switching operations with each operation consisting of a make and break. A standard padmounted transformer tank was adapted with an air cylinder and arm mechanism to remotely operate the fuseholder bayonet. The test circuit was set up using ANSI/IEEE STD 386-1985 as a guideline. An RTE C14 or larger fuse is mounted in the cartridges fuseholder during the testing. The fuseholder passed the tests if there was no significant damage to the fuseholder or stationary contacts.

In Test 5, a fuseholder was mounted in a standard oil filled padmounted transformer tank. Single phase test circuits were created using ANSI C37.41-1981 for distribution oil cutouts as a guideline. The fuseholders were fused with RTE current and dual sensing fuse links. Bolted faults were taken to determine the available current at a specific closing angle. The fuseholder bayonet was energized, the fuse melted, and the current was interrupted by the fuse cartridge or taken off line by the circuit backup if it did not clear. If the fuse cartridge cleared the circuit, the same cartridge and end cap was refused and retested up to a maximum of five times.

A final series of tests included mounting several fuseholders in the housing having copper housing contacts as shown in FIG. 2, and subjecting the fuse contacts to an 8.3 kV at 3810 amps., in mineral oil at 25° C. The fuseholders were removed and re-inserted 4 times with minimal observable arcing and minimal erosion or pitting of the surface of the contacts.

I claim:

1. A fuseholder comprising first and second electrically conductive metal fuse contacts having outer chamfers thereon, and an insulating tube therebetween, the improvement characterized in that the second metal fuse contact is an extended contact having an inner chamfer, the top of the insulating tube has a sharp edge and discontinuity near the second fuse contact inner chamfer, and the ratio of the first fuse contact exposed length second, extended fuse contact exposed length is from 1:1.3 to 1:2.5.

2. The fuseholder of claim 1, wherein the insulating tube comprises a fiber reinforced, thermoset resin impregnated structure which extends underneath a portion of each contact.

3. The fuseholder of claim 1, where the ratio of the first fuse contact exposed length: second, extended fuse contact exposed length is from 1:1.4 to 1:2.0 and the angle of the inner chamfer of the extended contact is from 20° to 45° from the longitudinal axis of the fuseholder.

4. The fuseholder of claim 1, having a metallic fuse element connected to the contacts through the interior of the tube.

5. The fuseholder of claim 1, where the contacts are brass, and the insulating tube comprises a filament wound glass fiber reinforced, cycloaliphatic resin impregnated structure.

6. A draw-out device for use in an electrical distribution apparatus, where the device comprises:

(1) a housing having a bottom end adapted to be in contact with a dielectric fluid, and also having spaced top housing contact sets and bottom housing contact sets, and (2) a removable draw out fuseholder within said housing, the fuseholder comprising a first electrically conductive metal fuse contact having an outer chamfer and a circumferential top surface, a second, extended, electrically conductive metal fuse contact having an inner chamfer, an outer chamfer and a circumferential top surface, and an insulating tube comprising a thermoset resin between the fuse contacts, where the top of the insulating tube has a sharp edge and discontinuity near the second fuse contact inner chamfer, the ratio of first fuse contact exposed length: second fuse contact exposed length is from 1:1.3 to 1:2.5, and where the housing contacts can be in engagement with the fuseholder such that the bottom housing contact set is completely disengaged from the first fuse contact while the top housing contact set is disposed over the second fuse contact inner chamfer.

7. The draw-out device of claim 6, where the housing contact sets are pressure mounted.

8. The draw-out device of claim 6, where the insulating tube of the fuseholder comprises a filament wound glass fiber reinforced cycloaliphatic epoxy resin impregnated structure which extends underneath a portion of each contact.

9. The draw-out device of claim 6, where, in the fuseholder, the ratio of the first fuse contact exposed length: second, extended fuse contact exposed length is from 1:1.4 to 1:2.0.

10. The draw-out device of claim 6, where, in the fuseholder, the angle of the inner chamfer of the extended contact is from 20° to 45° from the longitudinal axis of the fuseholder.

11. The draw-out device of claim 6, where the fuseholder has a metallic fuse element connected to the fuse contacts through the interior of the tube.

* * * * *